US006257837B1

(12) United States Patent
Adams et al.

(10) Patent No.: US 6,257,837 B1
(45) Date of Patent: Jul. 10, 2001

(54) VARIABLE OIL FLOW REGULATOR AND METHOD THEREFOR

(75) Inventors: Terry Adams, Rossendale; Roger Cook, Warrington; Stephen Eaton, Bolton, all of (GB)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/293,573

(22) Filed: Apr. 16, 1999

(30) Foreign Application Priority Data

Dec. 18, 1998 (GB) ..... 9827770

(51) Int. Cl.[7] ..... F16K 31/122

(52) U.S. Cl. ..... 417/228; 251/63; 251/63.5; 418/88

(58) Field of Search ..... 417/228, 281, 417/282; 418/84, 87, 99, 201.2, 98; 251/63, 63.5

(56) References Cited

U.S. PATENT DOCUMENTS

| | | | | |
|---|---|---|---|---|
| 3,734,653 | * | 5/1973 | Edstrom et al. | 418/88 |
| 3,759,636 | | 9/1973 | Schaefer et al. . | |
| 4,016,897 | * | 4/1977 | Asioli | 137/107 |
| 4,042,310 | * | 8/1977 | Schibbye et al. | 417/310 |
| 4,076,461 | * | 2/1978 | Moody, Jr. et al. | 417/310 |
| 4,276,960 | | 7/1981 | Webb et al. . | |
| 4,473,093 | * | 9/1984 | Hart | 137/522 |
| 4,503,685 | | 3/1985 | DeCarlo et al. . | |
| 4,542,766 | | 9/1985 | Gawer et al. . | |
| 4,639,196 | | 1/1987 | Kirkland, Jr. . | |
| 4,645,431 | * | 2/1987 | Spencer et al. | 417/401 |
| 5,139,399 | * | 8/1992 | Hood | 418/9 |
| 5,201,648 | * | 4/1993 | Lakowske | 418/201.2 |
| 5,215,444 | * | 6/1993 | Bishoff | 417/281 |
| 5,341,658 | | 8/1994 | Roach et al. . | |
| 5,388,967 | * | 2/1995 | Firnhaber | 417/295 |
| 5,832,737 | * | 11/1998 | Moilanen | 62/228.5 |

FOREIGN PATENT DOCUMENTS

| | | |
|---|---|---|
| 636 782 | 5/1950 | (GB) . |
| 1 597 718 | 9/1981 | (GB) . |
| 2 147 363 | 5/1985 | (GB) . |
| 2 269 424 | 2/1994 | (GB) . |
| 2 041 450 | 2/1996 | (WO) . |

* cited by examiner

*Primary Examiner*—Teresa Walberg
*Assistant Examiner*—Jeffrey Pwu
(74) *Attorney, Agent, or Firm*—Michael, Best & Friedrich LLP

(57) ABSTRACT

A variable oil flow regulator for minimizing noise generated typically by an oil-injected rotary screw compressor when the compressor transitions from an on-load mode for compressing fluid to an off-load mode. The regulator includes a housing having a first end, a second end and a chamber formed therein extending between the first and second ends. The regulator also includes a first port formed at the first end of the housing for admitting a pressure signal into the chamber corresponding to a compression level of the fluid, a second port formed at the second end of the housing for admitting the oil into the chamber, and a third port formed in the housing between the first and second ends of the housing for discharging the oil admitted into the chamber through the second port. The regulator further comprises a piston slidably disposed in the chamber between the first and second ends of the housing, the piston having a first end in fluid communication with the pressure signal and a second end in fluid communication with the oil. The piston is movable into a first position for allowing unrestricted flow of the oil between the second and third ports when the compressor is in the on-load mode and into a second position for restricting flow of the oil between the second and third ports when the compressor is in the off-load mode, the position of the piston being dependent upon the pressure differential between the pressure signal and the oil.

20 Claims, 5 Drawing Sheets

VARIABLE OIL FLOW REGULATOR AND METHOD THEREFOR

BACKGROUND OF THE INVENTION

1. Field of the Invention

The present invention generally relates to the art of compressing a fluid in an oil-injected rotary screw compressor. More specifically, the present invention relates to a variable oil flow regulator for a rotary compressor for minimizing noise generated by the compressor when the compressor transitions from an on-load mode to an off-load mode.

2. Brief Description of the Prior Art

Rotary compressors used to compress fluids, such as air or a refrigerant, generally include intermeshed male and female screw rotors mounted within a compression chamber of a rotor housing. The compression chamber may include a pair of parallel intersecting cylindrical bores which are sized to match the outside length and diameter dimensions of the intermeshed screw rotors. The intermeshed screw rotors are generally paired with one another so that a male rotor is paired with a female rotor, however, certain compressors may include three or more inter-meshed rotors.

During operation of the compressor, fluid (i.e., ambient air) at suction pressure enters the compression chamber via an inlet and is enveloped in a chevron-shaped pocket formed between the rotating screw rotors. As the rotors mesh and rotate within the compression chamber, the chevron-shaped pocket shrinks for decreasing the volume of the pocket and the pocket is displaced toward the outlet or high pressure end of the compressor. The air within the pocket is compressed by virtue of the decreasing volume of the pocket during rotation of the rotors. Due to the tight fit between the rotors and the walls of the intersecting cylindrical bores, the bearing arrangement in which the rotors are mounted is critical to efficient operation and life-span of the compressor. In addition, proper lubrication of the compression chamber with oil is of paramount concern in the design and operation of rotary screw compressors.

Oil is typically injected into the compression chamber through an injection port. The oil performs many useful functions. First, the injected oil provides a sealant between the intermeshed rotors and the cylindrical bores. The oil also acts as a lubricant between the driving screw rotor (i.e., a male rotor) and the driven screw rotor (i.e., a female rotor). As is known to those skilled in the art, one of the two screw rotors is generally driven by an external source, such as an electric motor, while the other rotor is driven by virtue of its meshing relationship with the motor-driven rotor. Oil injected into the compression chamber of the compressor therefore acts to prevent excessive wear between the driving and driven rotors. Finally, injected oil is used to cool the fluid undergoing compression within the compression chamber. This cooling methodology reduces thermal expansion of the rotors that would otherwise occur as a result of the heat generated during the compression process. In addition, utilizing the oil as a coolant permits even tighter clearances between the rotors and the cylindrical bores within the rotor housing.

Due to the important role which oil may play during the compression process, the proper control of the volume and flow of oil throughout the compressor is critical. One particular method of control uses an oil stop valve for stopping the flow of oil when the compressor shuts down, thereby preventing overflow and the possibility of hydraulic lock upon a restart. The oil stop valve is frequently controlled electrically, by means of a solenoid valve which is generally costly and complicated. A simplified oil control valve is disclosed in commonly assigned U.S. Pat. No. 4,639,196 to Kirkland which teaches a fluid control valve for controlling oil flow in and to a compressor which requires no electrical controls, and no spring biasing, and which comprises a simple, cartridge-type housing to facilitate its employment in a compressor housing.

Although the '196 patent has provided an effective and simple oil control valve for stopping the flow of oil during a compressor shutdown, there are many instances when it is undesirable to continuously stop and restart a compressor in response to demand. For example, certain compressors utilize star-delta motors which may only be started a limited number of times within a set time frame. Specifically, one particular star-delta motor may only be started 20 times within a one hour period. Attempts to start this particular motor more than 20 times in one hour may result in severe and permanent damage to the motor. As such, instead of continuously stopping and starting the motor, in certain instances it may be preferable to continuously operate the compressor. With these continuously operating compressors, when there is a demand for compressed air, the compressor is placed in an on-load mode so that the compressor may produce compressed air. However, when demand ceases, the compressor transitions to an off-load mode whereby the inlet valve for the compressor is at least partially (and preferably completely) closed and the compressed fluid stored in a compressed fluid storage tank is vented to atmosphere.

When transitioning from the on-load mode to the off-load mode, it is well known to those skilled in the art that the rotary compressor typically creates transition noise. Transition noise is frequently described as a rattling or howling noise produced by the rotors when the compressor transitions from the on-load mode to the off-load mode. Although the present invention is not limited by any particular theory of operation, it is believed that the compressible fluid or air introduced into the compression chamber tends to keep the rotors away from one another. However, when the inlet valve is at least partially closed the rotors are not compressing a standard amount of air so that the rotors tend to become unstable and being to make howling or rattling noises. It is believed that the rattling and/or howling noises result from a rapid pressure change within the compression chamber, resulting in the rotors becoming unstable with respect to one another.

Thus, there is a need for a device for use with a rotary compressor or a method which minimizes transition noise when the compressor transitions from an on-load mode to an off-load mode. In particular, there is a need for a variable oil flow regulator which is capable of reducing the flow of the oil and compressible fluid introduced into the compression chamber during the transition period in order to minimize the transition noises traditionally generated within the compressor during this period.

SUMMARY OF THE INVENTION

Certain preferred embodiments of the present invention include a variable oil flow regulator for minimizing noise generated by an oil-injected rotary screw compressor when the compressor transitions from an on-load mode, whereby the compressor produces and stores compressed fluid, to an off-load mode, whereby the compressor produces little or no compressed fluid and vents any compressed fluid stored therein to atmosphere. The compressor preferably includes rotors which are continuously driven by a motor when the compressor is in both the on-load mode and the off-load mode. Thus, the rate of rotation of the rotors does not vary between the on-load and off-load modes. However, as will be set forth in more detail below, when the compressor is in the off-load mode, the inlet vent for drawing fluid or air into the compressor is at least partially closed and the compressed fluid stored in the storage tank is vented to the atmosphere.

The variable oil flow regulator preferably includes a housing having a first end, a second end and a chamber formed therein extending between the first and second ends. The housing preferably defines a central axis extending between the first and second ends thereof. The housing includes a first port formed at the first end of the housing and opening into the chamber for admitting a pressure signal into the chamber which corresponds to a level of compression of the compressed fluid within the compression system. In certain embodiments, the pressure signal is a pneumatic signal representative of the pressure of the compressed fluid stored on the dry side of the oil/compressed fluid separator, i.e., after the oil has been removed from the compressed fluid. The variable oil flow regulator also includes a second port formed at the second end of the housing and opening into the chamber for admitting oil into the compression chamber. In preferred embodiments, the first and second ports may be in substantial alignment with one another and may be substantially centered on the central axis of the housing. The variable oil flow regulator also preferably includes a third port formed in the housing at a location spaced apart from, and more preferably between, the first and second ends of the housing. The third port opens into the chamber for discharging the oil which has previously been admitted into the chamber through the second port.

The variable oil flow regulator includes a piston slidably disposed in the chamber between the first and second ends of the housing. The piston may have a first end in fluid communication with the pressure signal of the compressed fluid and a second end in fluid communication with the oil admitted into the compression chamber. The housing preferably includes a substantially cylindrical bore surrounding the chamber and the piston is preferably slidably disposed within the bore. The substantially cylindrical bore surrounding the chamber may include a first section adjacent the first port and a second section disposed between the second and third ports. The first section of the bore preferably has a predetermined diameter and the second section of the bore may include a reduced diameter segment which is smaller than the predetermined diameter of the first section.

In certain preferred embodiments, the first end of the piston may have an outer, circumferential surface closely engaging the first section of the bore for guiding sliding movement of the piston within the bore. The second end of the piston may include a cylinder having an outer, circumferential surface with a diameter which is less than the reduced diameter of the second section of the bore. The regulator may also include a sealing element, such as an O-ring, for isolating the first and second sections of the chamber from one another so as to isolate the fluid entering the first port from the oil entering the second port. The sealing element may include a groove formed about the first end of the piston and an O-ring disposed in the groove for engaging the first section of the bore.

During operation, the piston is movable between a first position when the compressor is in the on-load mode and a second position when the compressor is in the off-load mode. In the first position, the second cylindrical end of the piston is vertically remote from the second reduced diameter section of the bore for allowing an unrestricted flow of oil between the second and third ports. However, in the second position the second cylindrical end of the piston is in substantial vertical alignment with the second reduced diameter section of the bore for at least partially restricting the flow of oil between the second and third ports. When the piston is in the second restricted flow position, an annular gap is formed between the outer surface of the second cylindrical shaped end of the piston and the reduced diameter segment of the second section of the bore, thereby restricting the flow of oil passing through the annular gap and onto the third port of the housing. In certain embodiments, the position of the piston is dependent upon the pressure differential between the pressure signal of the compressed fluid and the oil.

In further preferred embodiments, the variable oil flow regulator described above may include a mechanical biasing element for normally urging or biasing the piston into the first position, thereby providing an unrestricted flow of oil through the regulator during initial startup of the compressor and when the pressure of the oil is insufficient to overcome the combined forces of the mechanical biasing element and the pressure signal. The mechanical biasing element preferably includes a spring having a first end secured adjacent to the first end of the housing and a second end in contact with the piston. In preferred embodiments, the second end of the spring may engage the piston, such as by engaging the first end of the piston.

Preferred embodiments of the present invention also provide methods of minimizing noise generated by an operating rotary compressor during transition from an on-load mode to an off-load mode. In one preferred embodiment, the method includes the steps of providing a compressor including a compression chamber with at least two rotors driven by a motor connected thereto, an inlet for introducing a compressible fluid and oil into the compression chamber and an outlet for discharging the fluid and the oil from the compression chamber after the fluid has been compressed by the at least two rotors. The compressor preferably includes an inlet valve for modifying the volume of the fluid drawn into the compression chamber and at least one tank for storing the compressed fluid discharged from the compression chamber.

The method may also include operating the compressor in the on-load mode including the steps of driving the at least two rotors with the motor, opening the inlet valve and drawing the fluid into the compressor, introducing the fluid and the oil into the compression chamber, compressing the fluid and the oil with the at least two rotors in the compression chamber, discharging the compressed fluid and the oil from the compression chamber, and storing the compressed fluid in the at least one storage tank. The at least one storage tank may include an oil separator tank or a compressed fluid storage tank.

The method may also include the step of transitioning operation of the compressor from the on-load mode to the off-load mode. The transitioning step preferably includes continuing the step of driving the at least two rotors with the motor, at least partially closing the inlet valve for reducing the volume of the fluid introduced into the compression chamber, discharging at least a portion of the compressed fluid stored in the at least one storage tank, and reducing the volume of the oil introduced into the compression chamber. The transitioning step may further include the step of increasing the volume of the oil introduced into the compression chamber after the reducing the volume of the oil step. The step of at least partially closing the inlet valve may include the step of fully closing the inlet valve. The step of discharging at least a portion of the compressed fluid stored in the at least one storage tank may include the step of completely discharging the compressed fluid stored in the at least one tank. The at least one tank may include an oil separator tank.

These and other objects, advantages and features of the present invention will become more readily apparent in view of the following detailed description of preferred embodiments, drawings and claims.

DETAILED DESCRIPTION OF PREFERRED EMBODIMENTS

Figure 1:
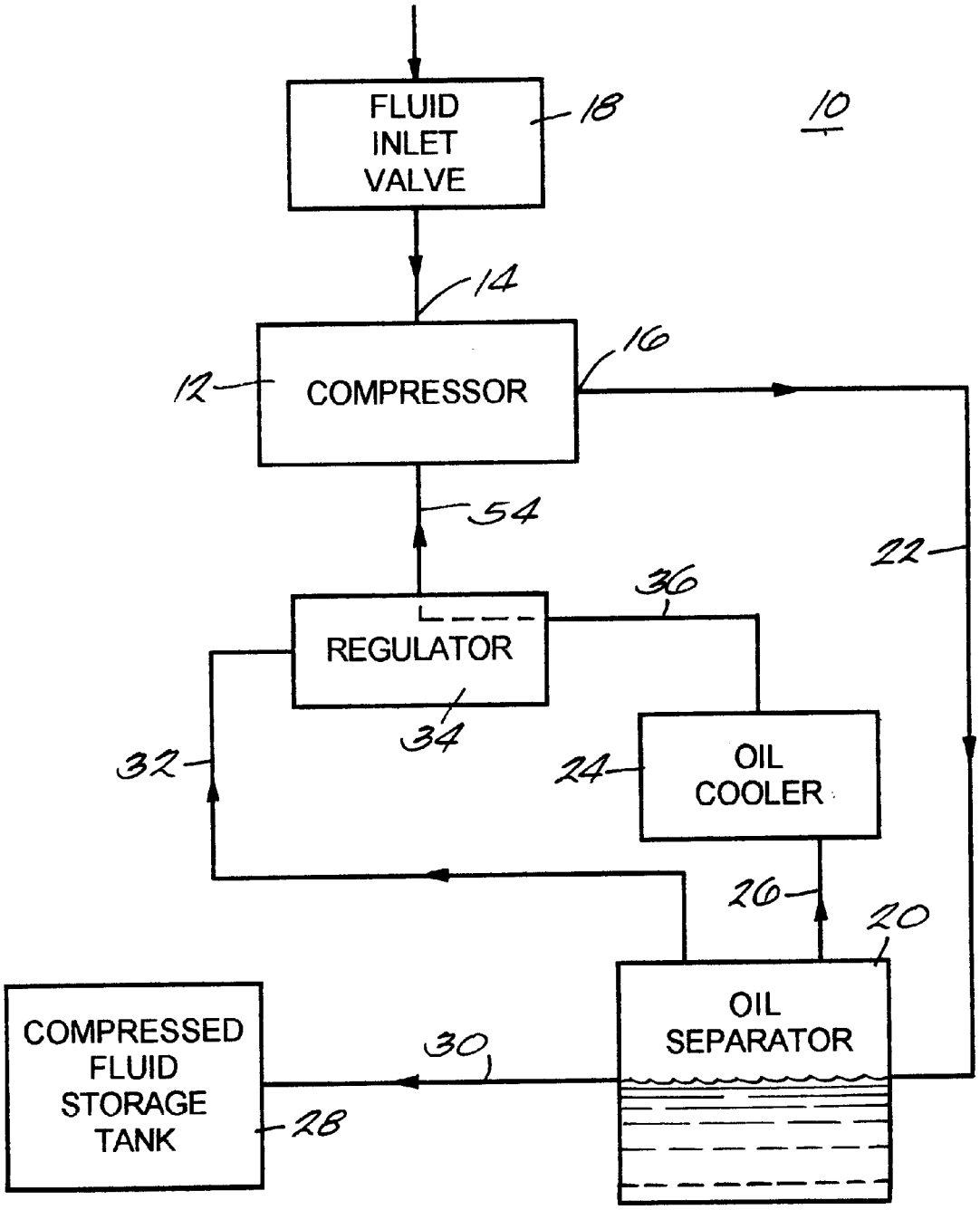
FIG. 1 shows a schematic diagram of a compression system including a variable oil flow regulator, in accordance with certain preferred embodiments of the present invention.

Referring to FIG. 1, in one preferred embodiment of the present invention, a fluid compression system 10 includes a compressor 12 having a fluid inlet 14 at one end thereof and a compressed fluid outlet 16 at the other end. The fluid may include air, refrigerant, or any other fluid typically compressed using a compressor. The volume of fluid introduced into the compressor 12 through the fluid inlet 14 is controlled by a fluid inlet valve 18. The compressor 12 preferably includes a rotor housing having a compression chamber and a pair of screw rotors mounted for rotation within the compression chamber, as disclosed in commonly assigned U.S. Pat. No. 5,139,399, the disclosure of which is hereby incorporated by reference herein. After the fluid is introduced into the compression chamber, the fluid is compressed in pockets formed between the two rotors. The pockets generally decrease in size as the fluid moves from the inlet end 14 to the outlet end 16 of the compression chamber, thereby compressing the fluid before it is discharged from the compressor 12. After the fluid has been compressed, the compressed fluid is discharged from the compressor 12 and supplied to an oil separator tank 20 via line 22.

The oil separator tank 20 separates any oil, condensation or particulate matter present in the compressed fluid after the fluid has been discharged from the compressor 12. The separated oil is then transferred downstream to an oil cooler 24 via line 26 and the compressed fluid (substantially oil-free) is stored in the oil separator tank prior to being discharged downstream to the end-user. However, in other preferred embodiments, the compressed fluid may be directed to a compressed fluid storage tank 28 via line 30 and stored therein. A pilot line 32 provides a pneumatic signal corresponding to the pressure of the compressed fluid in separator tank 20. The pilot line 32 is connected to a variable oil flow regulator 34 and the oil collected in oil cooler 24 is sent via line 36 to the variable oil flow regulator 34. As will be described in more detail below, the variable oil flow regulator 34 modifies and/or regulates the volume of oil provided to the compressor 12 in response to the strength of the pneumatic signal corresponding to the pressure of the fluid and the oil pressure signal.

Figure 2:
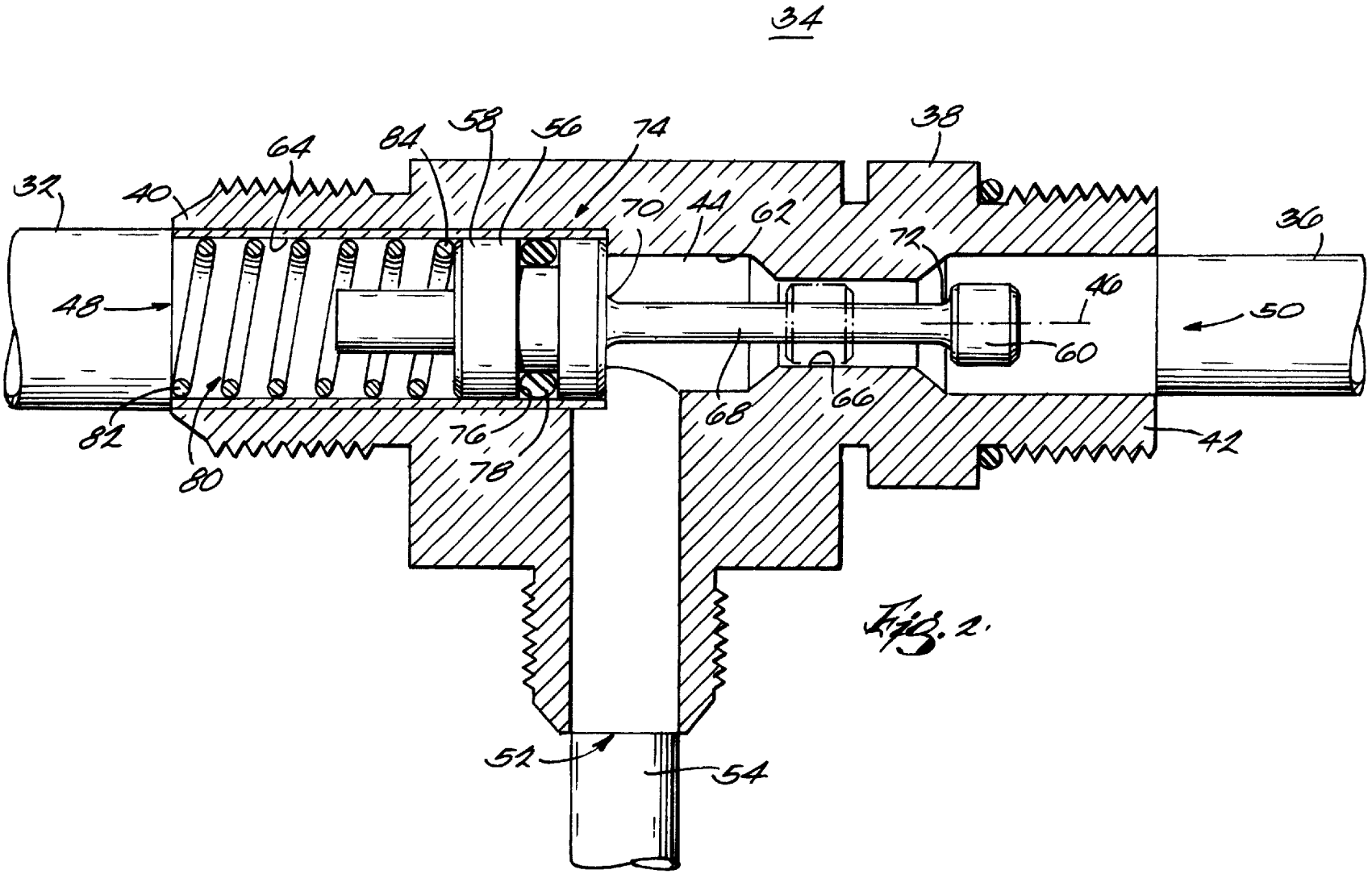
FIG. 2 shows a cross-sectional view of the variable oil flow regulator of FIG. 1 including a slidably disposed piston in a first unrestricted oil flow position, in accordance with certain preferred embodiments of the present invention.
Figure 3:
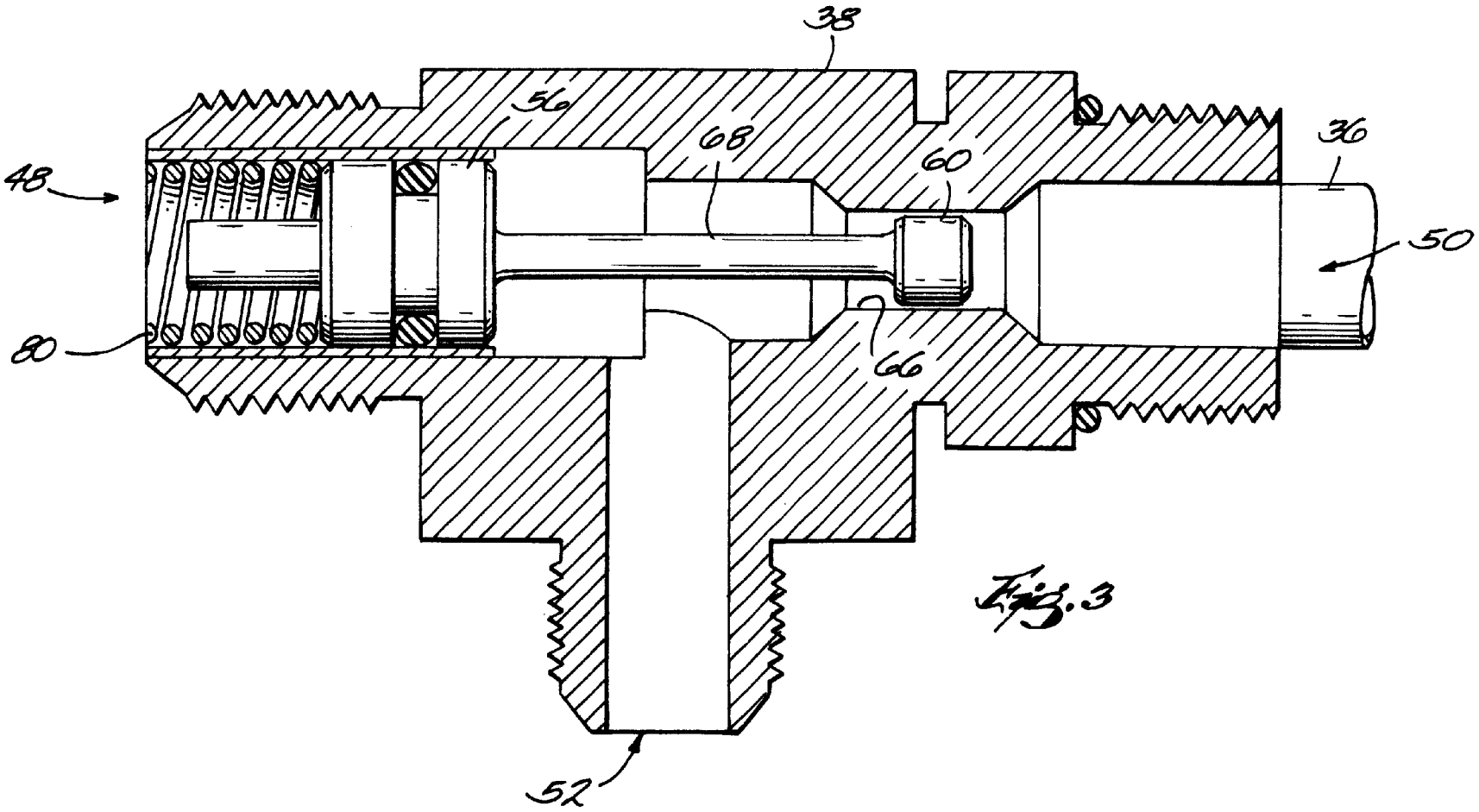
FIG. 3 shows the variable oil flow regulator of FIG. 2 with the slidably disposed piston in a second restricted flow position, in accordance with certain preferred embodiments of the present invention.

Referring to FIGS. 2 and 3, in accordance with certain preferred embodiments, the variable oil flow regulator 34 includes a regulator housing 38 having a first end 40, a second end 42 and a chamber 44 formed therein which extends between the first and second ends 40 and 42 thereof. The chamber 44 may be formed by boring an opening between the first and second ends 40 and 42 of the housing 38, whereby the opening preferably defines a central axis 46 extending between the first and second ends 40 and 42 of the housing 38. The housing includes a first port 48 formed at the first end 40 of the housing 38 in communication with line 32 which contains a pressure signal corresponding to the pressure of the compressed fluid in line 30 (FIG. 1). The first port 48 opens into the chamber 44 for admitting the compressed fluid pressure signal into the chamber. The variable oil flow regulator 34 also includes a second port 50 formed at the second end 42 of the housing 38 which is in communication with line 36. The second port 50 opens into the chamber 44 for admitting the oil, generally at a pressure level above atmospheric pressure, into the compression chamber. In preferred embodiments, the first and second ports 48 and 50 are in substantial alignment with one another and may be centered on the central axis 46 of the housing 38. The variable oil flow regulator 34 also preferably includes a third port 52 formed in the housing 38 at a location spaced apart from, and preferably between, the first and second ends 40 and 42 of the housing 38. The third port 52 opens into the chamber 44 for discharging the oil which is admitted into the housing 38 through the second port 50. Referring to FIG. 1, the oil discharged through the third port 52 is introduced into the compressor 12 via line 54.

Referring to FIG. 2, the variable oil flow regulator 38 includes a piston 56 slidably disposed in the chamber 44 between the first and second ends 40 and 42 of the housing 38. The piston 56 preferably has a first end 58 in fluid communication with the pressure signal provided through line 32 and a second end 60, having a cylindrical-shaped outer surface, in communication with the oil provided via line 36. The piston 56 is adapted for sliding freely along the central axis 46 so that the position of the piston is dependent upon the pressure differential between the pressure signal of the compressed fluid provided through line 32 and the pressure of the oil provided through line 36.

The chamber 44 may be formed by manufacturing a bore through the housing 38 so that the interior walls 62 of the bore define the parameters of the chamber 44. In preferred embodiments, the bore is substantially cylindrical and includes a first section 64 adjacent to the first port 48 and a second section 66 disposed between the second and third ports 50 and 52. The first section 64 of the bore preferably has a predetermined diameter and the second section 66 of the bore preferably includes a segment having a reduced diameter which is smaller than the predetermined diameter of the first section 64.

In certain preferred embodiments, the first end 58 of the piston includes an outer, circumferential surface closely engaging the inner wall 62 of the first section 64 of the bore for guiding the movement of the piston 56 along the central axis 46. The piston 56 also includes a relatively thin stem 68 having a first end 70 integrally connected to the first end 58 of the piston 56 and a second end 72 remote therefrom. The second end 72 of the stem 68 is connected to the second end 60 of the piston 56. The variable oil flow regulator 34 may also include a sealing element 74, such as an O-ring, for isolating the first and second sections 64 and 66 of the chamber 44 from one another for preventing the compressed fluid entering the first port 48 from coming in physical contact with the oil entering the second port 50. In preferred embodiments, the sealing element 74 may include a groove 76 formed about the first end 58 of the piston 56 with an O-ring 78 disposed in the groove 76 for engaging the inner wall 62 of the first section 64 of the bore. The O-ring 78 preferably includes a flexible material, such as rubber, which maintains close contact with the inner wall 62 of the bore as the piston 56 slides along the central axis 46.

In certain preferred embodiments, the variable oil flow regulator 34 includes a mechanical biasing element 80 for normally urging or biasing the piston 56 into the first position shown in FIG. 2. One particular benefit of this embodiment includes allowing for an unrestricted flow of oil through the regulator 34 during initial startup or restart of the compressor. The mechanical biasing element 80 may include a metallic spring having a first end 82 secured adjacent the first end 40 of the housing 38 and a second end 84 in contact with the piston 56. The second end 84 of the spring 80 preferably engages the first end 58 of the piston 56. In other preferred embodiments, the variable oil flow regulator 34 may not be biased so that the regulator does not use a spring to bias the piston 56 and the position of the piston depends exclusively on the pressure differential across the piston.

Referring to FIGS. 2 and 3, during operation of the compressor, the piston 56 is movable between the first position shown in FIG. 2 in which the compressor is in the on-load mode and the second position shown in FIG. 3 in which the compressor is in the off-load mode. In the first position shown in FIG. 2, the second end 60 of the piston 56 is spaced away from and/or remote from the second reduced diameter section 66 of the bore for allowing an unrestricted flow of oil between the second and third ports 50 and 52. In other words, the oil entering the second port 50 may freely move around the second end 60 of the piston 56 and the stem 68 thereof and pass out of the housing through the third port 52. However, when the pressure of the oil entering through the second port 50 via line 36 exceeds the combined force of the pressure of the compressed fluid entering through first port 48 and the bias force provided by the spring 80, the piston 56 moves to the second position shown in FIG. 3. In the second position shown in FIG. 3, the second end 60 of the piston 56 is in substantial vertical alignment with the second reduced diameter section 66 of the bore for at least partially restricting the flow of oil between the second and third ports 50 and 52.

Figure 4:
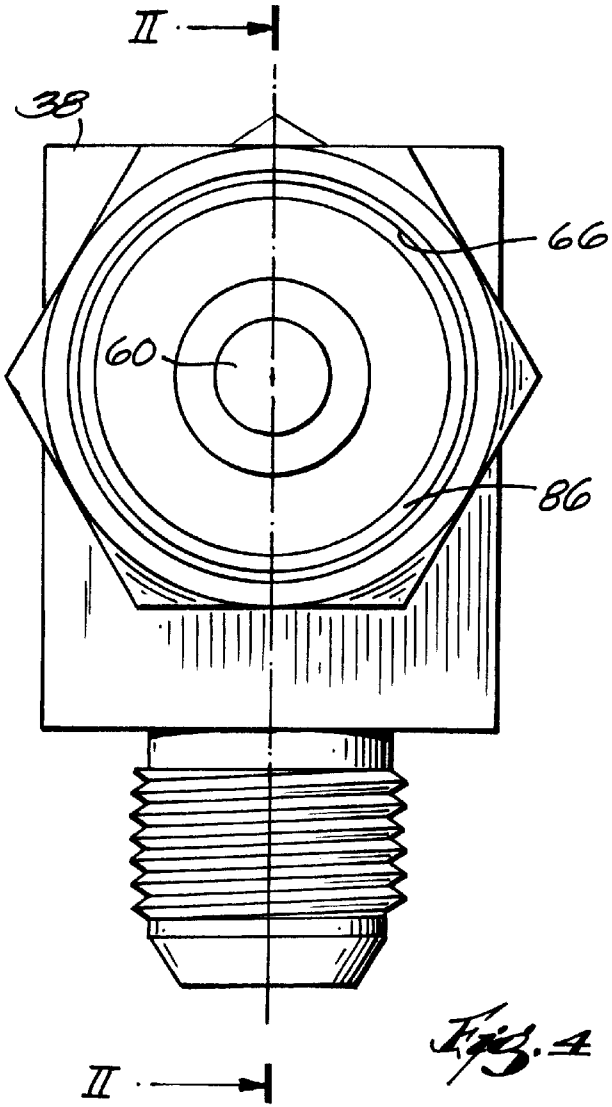
FIG. 4 shows a cross-sectional view of the variable oil flow regulator of FIG. 3 taken along line IV–IV.

Referring to FIGS. 3 and 4, in preferred embodiments the diameter of the second reduced diameter section 66 of the bore is suitably dimensioned so that the diameter of the second end 60 of the piston 56 is less than the second reduced diameter section 66 of the bore. In one particular preferred embodiment, the diameter of the second reduced diameter section 66 of the bore is approximately 9 mm and the diameter of the second end 60 of the piston 56 is approximately 8.5 mm. As a result, the piston 56 does not completely shut-off oil flow when the piston is in the second position. As shown in FIGS. 3 and 4, when the piston is in the second restricted flow position, an annular gap 86 is formed between the outer circumference of the second end 60 of the piston 56 and the second reduced diameter section 66 of the bore, thereby restricting (but not completely stopping) the flow of oil passing through the housing 38. As mentioned above, the reduction in both the volume of the oil and compressible fluid flowing into the compression chamber during transition to the off-load mode greatly minimizes transition noise.

Figure 5:
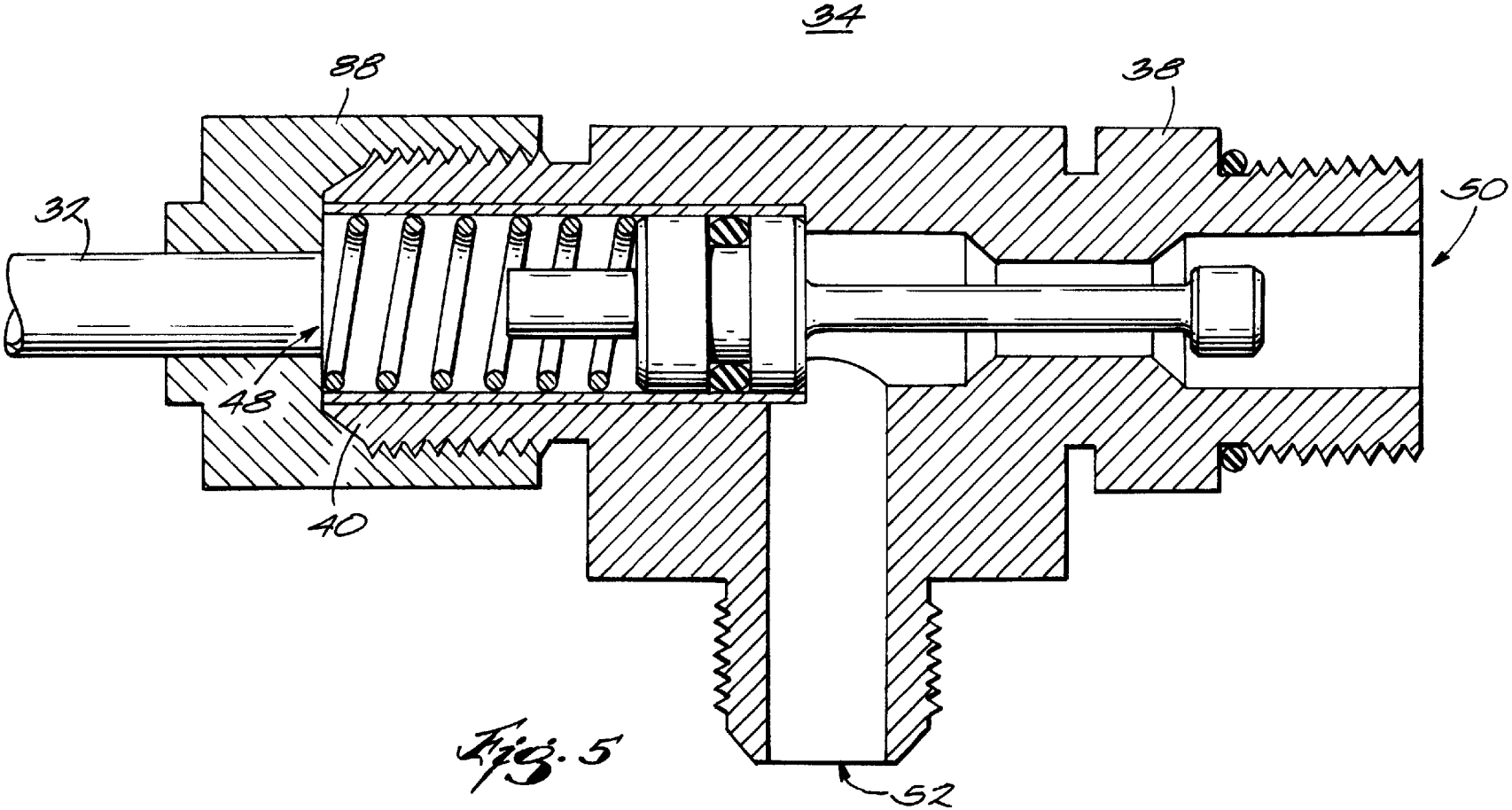
FIG. 5 shows a cross-sectional view of a variable oil flow regulator, in accordance with further preferred embodiments of the present invention.

Referring to FIG. 5, in certain preferred embodiments, an adapted 88 may be connectable to the variable oil flow regulator 34 for retaining the spring 80 within the bore. Specifically, the adapter 88 is secured over the first end 40 of the housing 38 and engages the first end 82 of the spring 80 for securing the spring 80 within the bore. In other embodiments, the first end 82 of the spring 80 may be retained within the bore using a securing element, such as a threaded nut.

The above disclosure describes only certain preferred embodiments of a variable oil flow regulator for a compressor and is not intended to limit the scope of the present invention to the exact construction and operation shown and described herein. The foregoing is considered to merely illustrate certain principles of the invention. For example, it is contemplated that the variable oil flow regulator disclosed herein may be used for any type of compressor (e.g., reciprocating, centrifugal, rotary) or pump. Thus, it should be evident to those skilled in the art that numerous modifications and changes may be made to the embodiments shown wherein while remaining within the scope of the present invention as described and claimed.

What is claimed is:

1. A variable oil flow regulator for minimizing noise generated typically by an oil-injected rotary screw compressor when said compressor transitions from an on-load mode for compressing fluid to an off-load mode, said variable oil flow regulator comprising:

a housing having a first end, a second end and a chamber formed therein extending between the first and second ends;

a first port formed at the first end of said housing for admitting a pressure signal into said chamber corresponding to a compression level of said compressed fluid;

a second port formed at the second end of said housing for admitting said oil into said chamber;

a third port formed in said housing between said first and second ends of said housing for discharging said oil admitted into said chamber through said second port; and a piston slidably disposed in said chamber between the first and second ends of said housing, said piston having a first end in fluid communication with the pressure signal and a second end in fluid communication with said oil, wherein said piston is movable into a first position for allowing unrestricted flow of said oil between said second and third ports when said compressor is in the on-load mode and into a second position for reducing flow of said oil to provide a reduced flow of said oil between the second and third ports when said compressor is in the off-load mode, the position of said piston being dependent upon the pressure differential between said pressure signal and said oil.

2. The variable oil flow regulator as claimed in claim 1, further comprising mechanical biasing means for normally biasing said piston into the first position so that unrestricted flow of said oil may occur during start-up of said compressor.

3. The variable oil flow regulator as claimed in claim 2, wherein said mechanical biasing means includes a spring having a first end secured adjacent the first end of said housing and a second end in contact with said piston.

4. The variable oil flow regulator as claimed in claim 1, wherein the second end of said spring engages the first end of said piston.

5. The variable oil flow regulator as claimed in claim 1, wherein said housing includes a substantially cylindrical bore surrounding said chamber.

6. The variable oil flow regulator as claimed in claim 5, wherein said housing defines a central axis extending between the first and second ends thereof and said piston is slidably disposed within said bore for moving along said central axis.

7. The variable oil flow regulator as claimed in claim 5, wherein said substantially cylindrical bore surrounding said chamber includes a first section adjacent the first port and a second section disposed between the second and third ports, the first section having a diameter and the second section having a reduced diameter which is smaller than the diameter of the first section.

8. The variable oil flow regulator as claimed in claim 6, wherein the first end of the piston has an outer, circumferential surface closely engaging the first section of said bore for guiding movement of said piston between the first and second positions.

9. The variable oil flow regulator as claimed in claim 8, wherein the second end of said piston includes an outer, circumferential surface having a diameter which is less than the reduced diameter of the second section of said bore.

10. The variable oil flow regulator as claimed in claim 9, wherein the second end of said piston is vertically remote from the second section of said bore having a reduced diameter when in the first position and is in substantial vertical alignment with the second section of said bore having a reduced diameter when in the second position.

11. The variable oil flow regulator as claimed in claim 10, wherein when said piston is in the second restricted flow position, an annular gap is formed the outer circumferential surface of the second end of said piston and the reduced diameter of the second section of the bore for restricting the flow of the oil which may pass through said housing.

12. The variable oil flow regulator as claimed in claim 1, further comprising sealing means for isolating the first and second sections of the chamber from one another so as to isolate the fluid entering the first port from the oil entering the second port.

13. The variable oil flow regulator as claimed in claim 12, wherein said sealing means includes a groove formed about the first end of the piston and an O-ring disposed in said groove for engaging the first section of said bore.

14. The variable oil flow regulator as claimed in claim 1, wherein said first and second ports are in substantial alignment with one another.

15. The variable oil flow regulator as claimed in claim 1, wherein said first and second ports are substantially centered on said central axis of said housing.

16. A method of minimizing noise generated by an operating rotary compressor during transition from an on-load mode to an off-load mode, the method comprising the steps of:

a) providing a compressor including a compression chamber with at least two rotors driven by a motor connected thereto, an inlet for introducing a fluid and oil into the compression chamber and an outlet for discharging the fluid and the oil from the compression chamber after said fluid has been compressed by said at least two rotors, said compressor including an inlet valve for modifying the volume of said fluid drawn into said compression chamber and at least one tank for storing the compressed fluid discharged from said compression chamber;

b) operating said compressor in the on-line mode including the steps of:
driving the at least two rotors with said motor,
opening the inlet valve and drawing the fluid into said compressor,
introducing the fluid and the oil into the compression chamber,
compressing the fluid and the oil with the at least two rotors in the compression chamber,
discharging the compressed fluid and the oil from the compression chamber, and
storing the compressed fluid in the at least one tank; and c) transitioning operation of the compressor from the on-line mode to the off-line mode, the transitioning step including the steps of:
continuing the step of driving the at least two rotors with said motor,
at least partially closing the inlet valve for reducing the volume of the fluid drawn into said compressor,
discharging at least a portion of the compressed fluid stored in the at least one tank, and
reducing the volume of the oil introduced into said compression chamber.

17. The method as claimed in claim 16, wherein the transitioning step further comprises the step of increasing the volume of the oil introduced into the compression chamber after the reducing the volume of the oil step.

18. The method as claimed in claim 16, wherein the step of at least partially closing the inlet valve includes the step of substantially closing the inlet valve.

19. The method as claimed in claim 16, wherein the step of discharging at least a portion of the compressed fluid stored in the at least one tank includes the step of completely discharging the compressed fluid stored in the at least one tank.

20. The method as claimed in claim 16, wherein said at least one tank includes an oil separator tank.

* * * * *